United States Patent [19]

Claassen

[11] Patent Number: 4,995,558

[45] Date of Patent: Feb. 26, 1991

[54] APPARATUS FOR APPLYING A THERMOPLASTIC HIGH-POLYMER MATERIAL, IN PARTICULAR AN ADHESIVE, TO A SUBSTRATE

[75] Inventor: Henning J. Claassen, Lüneburg, Fed. Rep. of Germany

[73] Assignee: Nordson Corporation, Westlake, Ohio

[21] Appl. No.: 311,309

[22] Filed: Feb. 16, 1989

[30] Foreign Application Priority Data

Mar. 23, 1988 [EP] European Pat. Off. ..... 88104676.7

[51] Int. Cl.[5] ..... B05B 7/04

[52] U.S. Cl. ..... 239/226; 239/237; 239/263; 239/381

[58] Field of Search ..... 239/226, 237, 263, 293, 239/380–381, 225.1

[56] References Cited

U.S. PATENT DOCUMENTS

| | | | |
|---|---|---|---|
| 1,876,607 | 9/1932 | Butterworth | 239/263 |
| 2,964,246 | 12/1960 | Alholm et al. . | |
| 4,308,447 | 12/1981 | Nötzold et al. | 219/421 |
| 4,744,517 | 5/1988 | Iwamoto et al. | 239/263 |
| 4,802,628 | 2/1989 | Dautel et al. | 239/380 X |

FOREIGN PATENT DOCUMENTS

| | | |
|---|---|---|
| 544969 | 2/1956 | Belgium . |
| 898413 | 11/1953 | Fed. Rep. of Germany . |
| 1208663 | 1/1966 | Fed. Rep. of Germany . |
| 2836545 | 11/1984 | Fed. Rep. of Germany . |
| 8534594 | 3/1986 | Fed. Rep. of Germany . |

*Primary Examiner*—Andres Kashnikow
*Assistant Examiner*—William Grant
*Attorney, Agent, or Firm*—Armstrong, Nikaido, Marmelstein, Kubovcik & Murray

[57] ABSTRACT

An apparatus for applying a thermoplastic high-polymer material, in particular an adhesive, to a substrate, comprising an application head having at least one feed passage for the liquefied material in the application head, a nozzle-like outlet opening at the end of the feed passage and a valve arrangement for opening and closing the feed passage or the outlet opening, respectively, includes a rotatable rotation element provided in the application head and having a passage which aligns with the feed passage and merges into the outlet opening.

5 Claims, 2 Drawing Sheets

APPARATUS FOR APPLYING A THERMOPLASTIC HIGH-POLYMER MATERIAL, IN PARTICULAR AN ADHESIVE, TO A SUBSTRATE

BACKGROUND OF THE INVENTION

1. Field of the Invention

The invention relates to an apparatus for applying a thermoplastic high-polymer material, in particular an adhesive, to a substrate.

2. Description of the Prior Art

The basic construction of such an apparatus can be seen, for example, from German utility model No. 8,534,594 and comprises an application head, a feed passage for the liquefied material in the application head, a nozzle-like outlet opening at the end of the feed passage and a valve arrangement for opening and closing the feed passage or the outlet opening, respectively. Not only the liquefied material is supplied to the application head but at the same time also a gas, generally air which is under pressure, so that the emerging material is atomized by the pressure gas and is applied in the form of a spray curtain or mist to the substrate to be coated.

With the apparatus according to German utility model No. 8,534,594 specific coating patterns can be produced by additional gas, in particular air streams, as are necessary for some purposes. However, in this case the outlet openings for the additional gas streams must be positioned and adjusted very exactly to obtain the desired patterns. Furthermore, it is not readily possible to deviate from a coating or spray pattern once it is set. Finally, a very complicated construction results with the external, additional outlet nozzles for the additional air flow.

SUMMARY OF THE INVENTION

The invention is thus based on the object to provide an apparatus for applying a thermoplastic high-polymer material, in particular an adhesive, to a substrate, in which the aforementioned disadvantages do not occur. In particular, an apparatus is to be suggested with which the coating pattern can be varied and modified in simple manner.

The invention therefore proposes in an apparatus for applying a thermoplastic high-polymer material, in particular an adhesive, to a substrate comprising an application head, at least one feed passage for the liquefied material in the application head, a nozzle-like outlet opening at the end of the feed passage and a valve arrangement for opening and closing the feed passage or the outlet opening, respectively, the improvement that a rotatable rotation element provided in the application head comprises a passage which is in communication with the feed passage and which merges into the outlet opening.

Expedient embodiments are defined by the features of the subsidiary claims.

The advantages achieved with the invention are based on the fact that integrated into the application head is a rotatably mounted rotation element comprising a passage aligned with the feed passage and the outlet opening, so that by corresponding design of the exit angle of the outlet opening different coating patterns can be achieved. If the rotation element is revolved by a drive means, in particular pneumatically, circular coating patterns can for example be produced when the outlet opening extends at an angle to the vertical, about which the element rotates. Said rotation results in a stretching of the emerging mass and thus a sort of spraying effect.

For its pneumatic rotation, the rotation element can be provided with a screw, past which a gas, in particular an air stream, flows and thereby rotates the screw and thus also the rotation element. By corresponding adjustment of the air pressure or volume, respectively, the rotational speed of the element and thus the range of the coating material emerging from the outlet opening and finally the diameter of the generated coating pattern can be adjusted.

Alternatively, the rotation element itself may be very simply and rapidly dismounted and replaced by an element with a differently configured outlet opening, allowing further coating patterns to be obtained.

BRIEF DESCRIPTION OF THE INVENTION

The invention will be explained hereinafter in detail with the aid of an example of embodiment with reference to the attached schematic drawings, wherein.

DESCRIPTION OF THE PREFERRED EMBODIMENT

Figure 1:
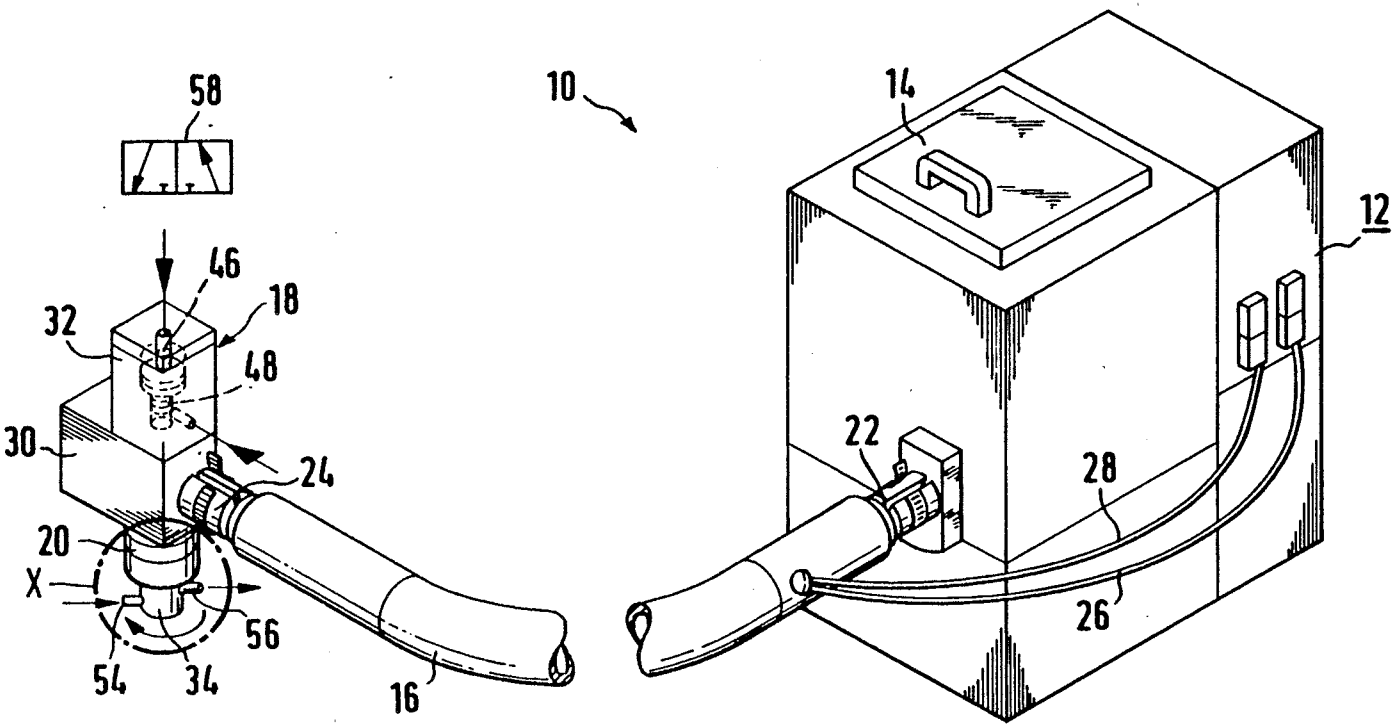
FIG. 1 is a perspective view of an apparatus for applying a thermoplastic high-polymer material, in particular an adhesive, by means of a stationary application head to a substrate.

The apparatus shown in FIG. 1 and denoted generally by the reference numeral 10 for applying a thermoplastic high-polymer material, that is an adhesive, to a substrate (not shown) comprises a liquefying unit 12 which has substantially the construction known from German Offenlegungsschrift No. 2,836,545. The liquefying unit 12 is provided at its upper side with a filling cover 14 for the adhesive to be replenished.

The liquefying unit 12 is connected via a thermally insulated hose 16 to an application head 18, at the lower side of which a nozzle 20 is provided for the application of the adhesive to a material web (not shown) to be coated with the adheseive. The hose 16 comprises at its inlet end a connecting piece 22 and at its outlet end a connecting piece 24 which is mounted by corresponding counter pieces on the liquefying unit 12 and the application head 18, respectively. The connections are surrounded by a thermally-insulating sleeve.

At the inlet end of the hose 16 two lines are led outwardly through the outer wall thereof, namely a supply line 26 connected to a heating strip in the interior of the hose 16 and a control line 28.

The application head 18 comprises a body 30 which is connected at its lower end, to the outlet nozzle 20 and at its upper end to a terminal 32 for compressed air which serves for actuation, to be explained below, of a valve arrangement provided in the application head 18.

Figure 2:
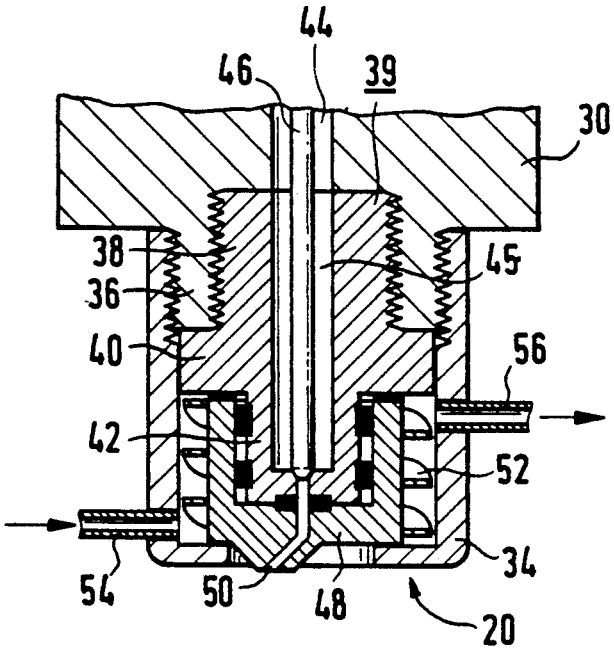
FIG. 2 shows an enlarged view of the detail X of FIG. 1.

The part of the application head 18 of interest here, i.e. the outlet nozzle 20, is shown in FIG. 2. The outlet nozzle 20 comprises a cap-like housing 34 which is screwed via an internal thread to the external thread of a correspondingly shaped extension 36 of the body 30. The extension 36 comprises a cylindrical bore in which a corresponding extension 38 of an adapter or intermediate piece 39 is diposed. The extension 38 of the adapter 39 is followed by a widening portion 40, the outer diameter of which is somewhat smaller than the outer diameter of the sleeve 36. At its lower end the adapter 39, i.e. the widening portion 40, merges into a cylindrical end piece 42.

The intermediate piece 39 with the parts 38, 40, 42 can be screwed into the housing 30, namely with its extension 38.

The housing 30 comprises a feed passage 44 for the liquefied adhesive which merges into a corresponding feed passage 45 with identical diameter in the adapter 39. At the lower end of the adapter 39, i.e. in the region of the extension 42, the diameter of the passage 45 in the adapter 39 diminishes.

Arranged in the passages 44, 45 in the housing 30 and the intermediate piece 39 is a reciprocatable valve needle 46, the lower end of which rests on the passage constriction at the lower end and thereby blocks the passage 45 (cf. FIG. 2).

At the upper end the valve needle 46 is connected to a step or differential piston 48 (cf. FIG. 1) which is pneumatically actuated, i.e. reciprocated, to bring the valve needle 46 into and out of engagement with the constriction of the feed passage 45 and thereby open or close said feed passage 45.

Integrated into the lower end of the outlet nozzle 20 is a cap-like rotation element 48 of U-shaped cross-section, the inner faces of which, i.e. the inner faces of its side walls and its bottom, engage the corresponding counterfaces of the extension 42. The upper edges of the side walls engage the widening portion 40 from below. To permit easy rotation of the rotation element 48 rotary bearings indicated in black in FIG. 2 are disposed between said faces.

The constricted passage 45 in the extension 42 continues through the bottom of the rotation element 48 and then bends somewhat towards the outlet 50 thereof so that the latter is arranged obliquely with respect to the feed passage 44.

The lateral outer wall of the rotation element 48 is provided with a revolving screw 52 which serves as flow guide; the windings of said screw 52 can be seen in FIG. 2.

The rotation element 48 and the screw 52 can freely rotate in the space between the cap-like element 34 and the extension 42.

The cap 34 is provided with an inlet 54 for compressed air and at the opposite side with an outlet 56 for compressed air; the flow direction of the compressed air is indicated in each case by the arrows.

For assembly of the nozzle 20 the intermediate piece 39 is screwed into the lower end of the body 30. The rotational element 48 is then inserted with the ability to freely rotate, and finally the cap 34 is screwed onto the intermediate piece or adapter 39 and onto the extension 36 of the body 30. The rotation element 48 is thereby mounted freely rotatably about a vertical axis.

If compressed air is now introduced via the inlet 54, it flows through the gap between the cap 34 and the rotation element 48 along the windings of the screw 52, so that the latter is entrained and thereby the rotation element 48 revolves. On the opposite side the compressed air flows through the outlet 56 out of said gap.

On revolving of the rotation element 48 its outlet 50 is also rotated on a circular path about the feed passage 45, so that the liquified coating material emerging from said outlet 50 is cast in a circular path onto the substrate (not shown) to be coated passing therebelow and thus generates predetermined coating patterns corresponding substantially to spray patterns.

The liquified adhesive from the liquefying unit 12 is supplied to the application head 18 via the hose 16 and has a predetermined pressure in the feed passage 44. In the position of the valve needle 46 shown in FIG. 2 the feed passages 44, 45 and thus the outlet 50 is blocked, so that no adhesive can emerge. The differential piston 48 of the valve needle 46 is now pneumatically actuated and thereby displaced upwardly in accordance with the illustration of FIG. 2, so that the feed passages 44, 45 and thus the outlet opening 50 open.

In FIG. 1 the streams of compressed air for the pneumatic actuation of the valve needle 46 are indicated by arrows. In addition, an electromagnetic valve 58 is shown which serves to control the application of the compressed air to the differential piston.

By increasing the air pressure or the amount of compressed air, respectively, supplied to the inlet 54, the compressed air application to the rotation element 48, its rotation speed and thus finally the diameter of the circular coating pattern dependent on the ballistics can be controlled.

If further modifications of the coating pattern are necessary, the rotation element 48 can also be dismounted as a whole and replaced by another rotation element 48 with a different configuration of the outlet 50, in particular with respect to the angle to the feed passages 44, 45.

Finally, although not apparent from the Figures, the liquefied adhesive in the feed passages 44, 45 can be atomized by compressed air, thereby converting the application head 18 to a spray head.

The same techniques can fundamentally be applied here as are described in German utility model No. 8,534,594. The air necessary for the spraying can be supplied separately via the adapter 39 by means of a further passage which opens into the outlet 50. Alternatively, it is also possible to supply this air via the rotation element 48, namely either via a separate passage or as "branch air" passage where part of the air supplied via the inlet 54 serves for spraying the adhesive.

The additional air nozzles known from German utility model No. 8,534,594 can also be integrated into the application head 18.

I claim:

1. Apparatus for applying a liquified thermoplastic high-polymer material to a substrate comprising: an application head, at least one feed passage for the liquified material in the application head, a valve arrangement for opening and closing the feed passage, a rotation element rotatably mounted to said application head, a liquified material passage extending through said rotation element, said liquified material passage having one end in communication with the feed passage and another end providing a nozzle-like outlet opening, a fluid power connection for connecting a source of fluid power to said application head, and fluid drive means carried by said rotation element and responsive to said fluid power for rotating said rotation element independently of the supply of liquified material to said application head.

2. Apparatus according to claim 1, wherein said nozzle-like outlet opening is arranged obliquely with respect to the feed passage.

3. Apparatus according to claim 1, wherein an outer circumference of said rotation element is provided internally of said application head and said fluid drive means for rotating the rotation element is provided in a space between said outer circumference of said rotation element and said application head.

4. Apparatus according to claim 3 wherein said fluid power source is a source of pneumatic pressure and said drive means for rotating the rotation element is a screw winding provided to the outer circumference of said rotation element.

5. Apparatus according to claim 1, wherein rotary bearings are disposed between surfaces of the rotation element and opposing surfaces of the application head.

* * * * *